United States Patent [19]

Kragt

[11] Patent Number: 4,928,399

[45] Date of Patent: May 29, 1990

[54] MARKING TEMPLATE

[75] Inventor: Gerald A. Kragt, Marne, Mich.

[73] Assignee: Jer's Pattern Project, Inc., Marne, Mich.

[21] Appl. No.: 288,487

[22] Filed: Feb. 9, 1989

[51] Int. Cl.[5] ..... B43L 13/20

[52] U.S. Cl. ..... 33/562; 144/144 R; 144/371; 33/481

[58] Field of Search ..... 33/562, 563, 565, 566, 33/197, DIG. 10, 415, 416, 417, 526, 481; 144/144 R, 144.5, 144.5 GT, 372

[56] References Cited

U.S. PATENT DOCUMENTS

| | | | |
|---|---|---|---|
| 904,003 | 11/1908 | Naldrett | 33/481 |
| 975,494 | 11/1910 | Adams | 33/416 |
| 1,048,333 | 12/1912 | Mishler | 33/481 |
| 1,125,010 | 1/1915 | Doner | 33/481 |
| 2,560,756 | 7/1951 | Bollons | 33/526 |
| 3,223,132 | 12/1965 | Erne | 33/197 |
| 3,386,177 | 6/1968 | Koscielski | 33/526 |
| 3,834,033 | 10/1974 | Pinicard | 33/563 |
| 4,168,730 | 9/1979 | Keller | 144/144.5 R |
| 4,361,964 | 12/1982 | Hennessee | 33/563 |
| 4,462,440 | 7/1984 | Dolfi | 144/144.5 R |
| 4,640,019 | 2/1987 | Paley | 33/563 |
| 4,648,433 | 3/1987 | Wolff | 33/562 |

*Primary Examiner*—William A. Cuchlinski, Jr.
*Assistant Examiner*—Diego F. F. Gutierrez
*Attorney, Agent, or Firm*—Waters, Morse & Harrington

[57] ABSTRACT

This marking template is preferably made from die-cut uncorrugated cardboard with slots and holes adapted to position a marking tool to define the positions of cuts and holes to be made in a piece of material. Provision is made for cuts to be made at compound angles by forming the slots to intersect a fold line in the template, or extend on opposite sides of it, the slots forming an angle other than perpendicular to the fold line at one or both sides of the fold line. The slot portions for each cut are coplanar. The portions at opposite sides of the slot thus form the traces of a cutting plane disposed at an angle to either of the faces of the template. The template is adapted to be provided in a plurality of sections with respect to length through the use of interengageable slots and tabs, or by nails engaging aligned holes, that assure longitudinal and transverse alignment of the template sections.

6 Claims, 2 Drawing Sheets

MARKING TEMPLATE

BACKGROUND OF THE INVENTION

The current interest in home workshop activities has generated a wide variety of plans for various articles that can be constructed from standard sizes of lumber. The principal material is the usual 2×4 and 2×6 used in the framing of houses. Actually, the standard dimension of these pieces in present use are 1½"×3½" and 1½"×5½" respectively. One form of plan developed by applicant is a template made as a long piece of uncorrugated cardboard with slots and punched out holes marked to indicate the cutting and drilling points for particular pieces in a project being built. The template has a fold line that embraces one corner of a piece of material. In this position, lines can be drawn through the slots, and marks made at the holes each identified as corresponding to a particular piece. The template is then removed, the cuts made, and holes drilled at the indicated positions.

There are several advantages to this form of pattern, not the least of which is a highly efficient use of the lumber. The obvious simplicity is a very favorable factor, in view of the principal use in the home workshop, where skill may be somewhat less than that of a professional carpenter. To make efficient use of long pieces of lumber, obviously the template has to be of corresponding length. There are not many facilities where the die-cutting of the slots and holes can be made in patterns exceeding four (4) feet in length. Standard 2×4 studs are twice that long, and the resulting problem is obvious. Providing special equipment capable of die-cutting patterns eight (8) feet or more in length in one operation is expensive. Another problem encountered in presently available patterns is the absence of any provision for indicating the cutting of compound angles, in which the plane of a cut is disposed at an angle other than ninety (90) degrees to at least one face of the material.

SUMMARY OF THE INVENTION

This marking template provides for proper marking of compound angles (where the cut is at an angle other than perpendicular to at least one face of the piece) by extending the marking slot to preferably intersect the fold line, and continue the trace of the cutting plane on both sides of the fold line. Extended templates can be made in interlocking sections, with the form of the interlock assuring alignment and dimensional continuity.

DESCRIPTION OF THE PREFERRED EMBODIMENT

Figure 1:
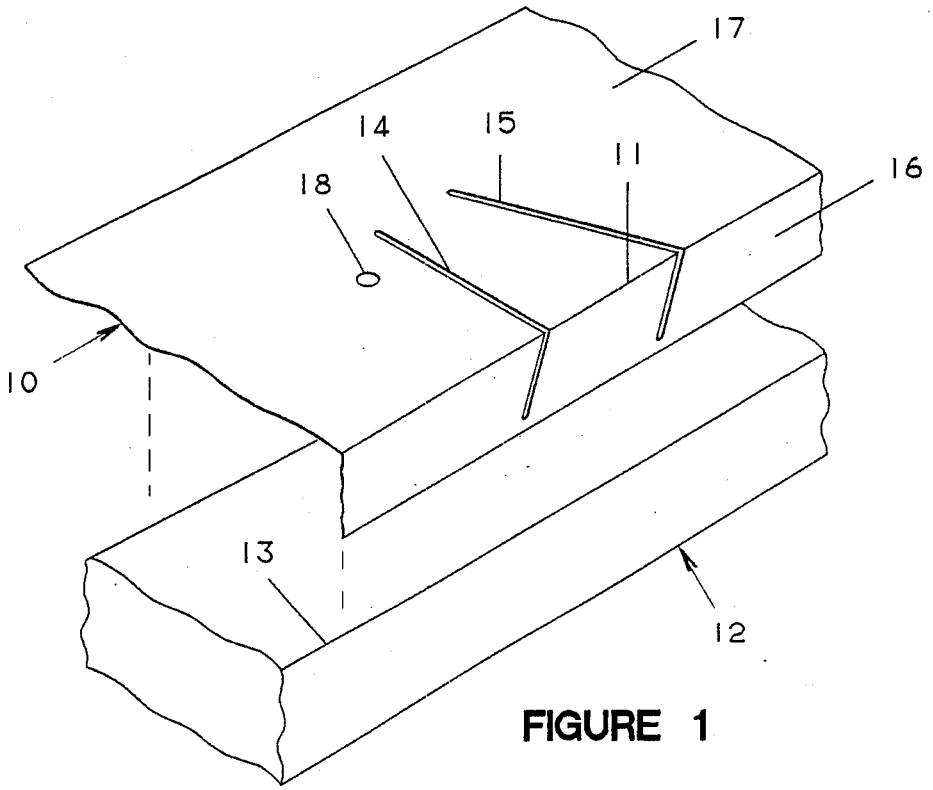
FIG. 1 is a fragmentary perspective view showing the marking template elevated from a piece of material to be marked for cutting.

Referring to the drawings, the template generally indicated at 10 is a panel of preferably die-cut 20 gage uncorrugated cardboard, with a fold line indicated at 11. In use, the pattern is lowered onto the 2×4 piece 12, with the fold line laid along the corner 13. In this position, a pencil can be inserted in the slots 14 and 15, and appropriate marks made on the piece 12 for reference later in cutting the piece with a saw. The portion of the slot 14 to the left and above the fold line, as viewed in FIG. 1 is perpendicular to the fold line, and the portion below it is disposed at an angle to the fold line. These slots constitute the traces of a cutting plane perpendicular to the face 16 of the panel, and disposed at an angle other than perpendicular to the face 17. The portion of the slot 15 to the left and above the fold, as viewed in FIG. 1, and also the extension of the slot below the fold line are both at angles other than perpendicular to the fold line. These two slots thus represent the traces of a cutting plane that is at an angle other than perpendicular to both the faces 16 and 17. It is preferable that the slots actually intersect the fold line, and thus be continuous over both the faces 16 and 17. It is possible to have a discontinuity of the slots at the fold line, as long as the slots in both faces are co-planar in the folded template. The punched hole 18 represents a position at which a nail can be inserted to mark the piece 12 for the later drilling of a hole.

Figure 2:
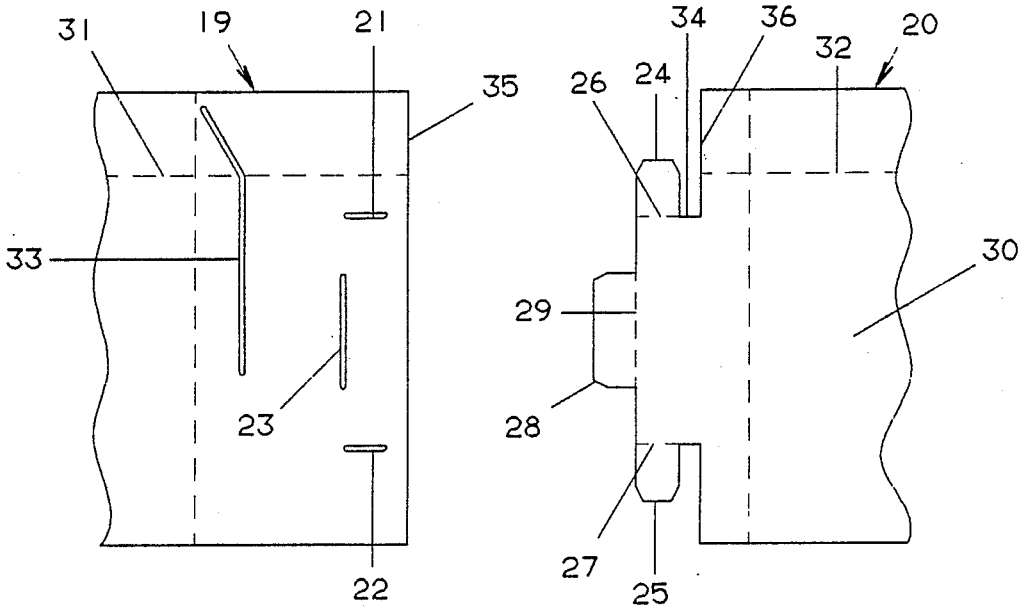
FIG. 2 is a plan view showing the two sections of a template with interengageable tabs and slots adapted to assure both linear and transverse continuity of the sections.

In order to adapt the pattern for use on pieces of material greater than four (4) feet in length, and still use generally available die-cutting equipment, the system shown in FIG. 2 is provided. The template is divided into two sections, indicated respectively at 19 and 20. The section 19 has the parallel slots 21 and 22 oriented along the length of the sections, and the transverse slot 23 perpendicular to the slots 21 and 22. The section 20 of the template has the tabs 24 and 25 defined by the fold lines 26 and 27, and the tab 28 defined by the fold line 29. The tabs 24 and 25 are disposed to engage the slots 21 and 22 respectively, when the tabs are bent to a position ninety (90) degrees from the plane of the panel 30. The fold lines 31 and 32 correspond to the fold line 11 of FIG. 1. The cutting slot 33 in the panel 19 is similar in configuration to the slot 14 of FIG. 1. When the tabs 24, 25, and 28 are properly engaged with the slots 21, 22, and 23, they are preferably bent back against the bottom of the template section 19, and taped in place. The arrangement of the slots 21 and 22 perpendicular to the slot 23 results in both longitudinal and transverse alignment of the template sections with respect to each other, so that the fold lines 31 and 32 are continuous. The extension neck 34 of the section 20 makes it unnecessary for the abutting edges 35 and 36 of the template sections to overlap, thus preserving planar continuity.

Figure 3:
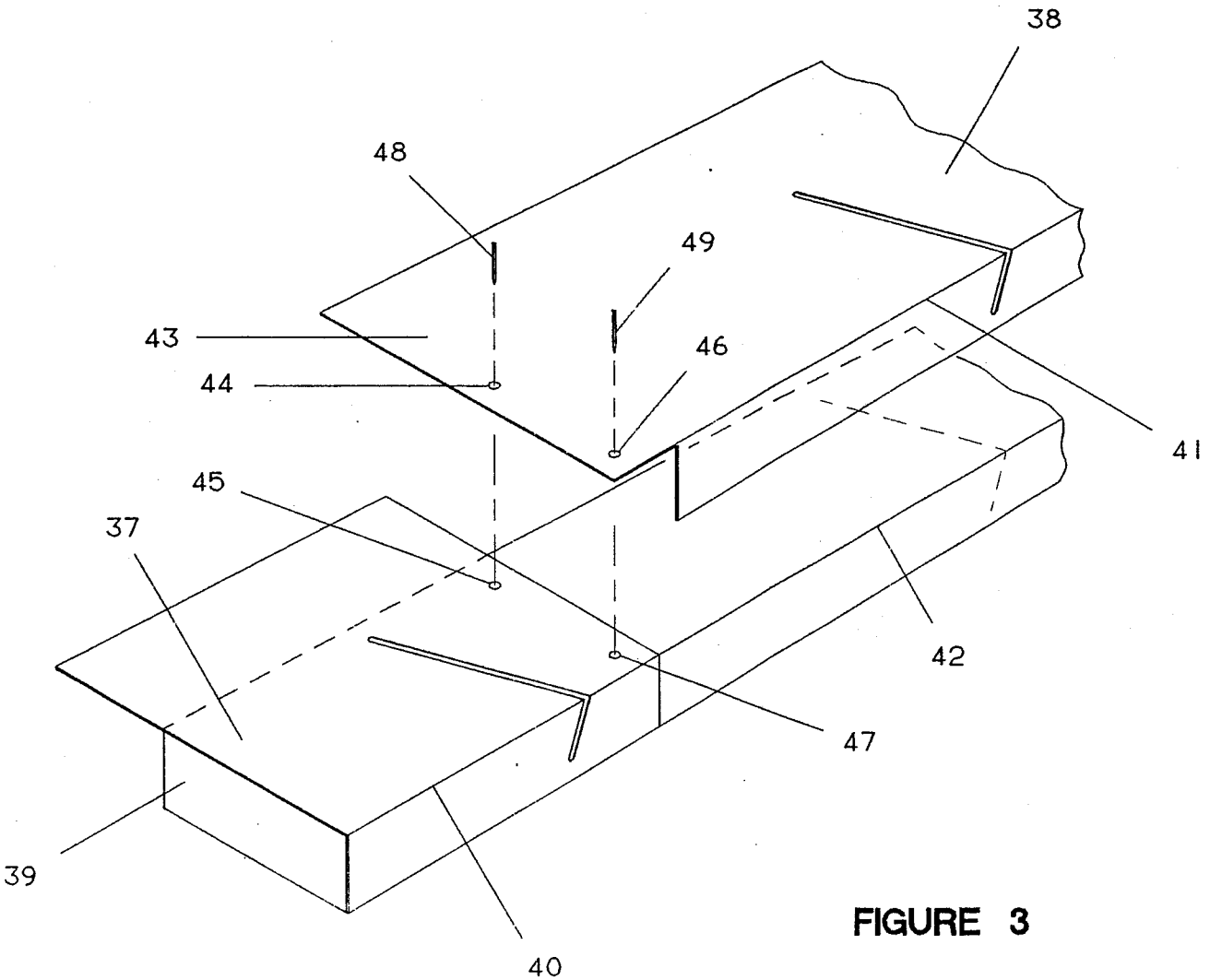
FIG. 3 illustrates an alternative system for assuring the alignment of successive sections of template.

Referring to FIG. 3, an alternative arrangement is shown for assuring the continuity of successive template sections. The sections 37 and 38 are to be used in marking the 2×4 piece of lumbar 39. The fold lines 40 and 41 will embrace the corner 42. The section 38 has a portion 43 overlapping the section 37, and these overlapping portions have aligned holes 44-45 and 46-47 for receiving the nails 48 and 49. These nails may be partially driven into the piece 39 through the holes in both templates at the same time. If the nails have small heads (as on finishing nails), they can be partially driven through the holes 45 and 47 into the piece 39, and the template section 38 pushed down over them to engage the holes 44 and 46.

I claim:

1. A marking template including at least two elongated panel sections each having a fold line adjacent one edge, and an array of marking slots, having portions extending on both sides of said fold line in coplanar relationship, in the folded condition of said template, corresponding to cutting lines to be made on pieces of material, said sections, when folded 90 degrees along said fold lines, being adapted to engage an edge and an adjacent face of a piece of material of standard width and thickness, wherein the improvement comprises:

overlapping end portions on said sections, said portions having aligned holes when said sections are in longitudinal alignment in sequence.

2. A template as defined in claim 1, wherein said aligned holes receive at least one nail for positioning said sections relative to each other.

3. A marking template including an elongated panel having a fold line adjacent one edge, and an array of marking slots corresponding to cutting lines to be made on pieces of material, said panel, when folded ninety (90) degrees along said fold line, being adapted to overlap an edge and an adjacent face of a piece of material of standard width and thickness, wherein the improvement comprises:

at least one marking slot having portions extending on both sides of said fold line in coplanar relationship, in the folded condition of said template, said panel being separable into at least two sections with respect to length, one of said sections having at least one flap the other of said sections having a slot disposed to receive said flap when folded to a position substantially perpendicular to said panel.

4. A template as defined in claim 3, wherein said one section has a pair of parallel flaps, and a flap perpendicular thereto, said flaps and slots being interengageable exclusively when said panel sections form continuations of each other at said fold line.

5. A marking template including at least two elongated panel sections each having a fold line adjacent one edge, and an array of marking slots corresponding to cutting lines to be made on pieces of material, said sections, when folded 90 degrees along said fold lines, being adapted to engage an edge and an adjacent face of a piece of material of standard width and thickness, wherein the improvement comprises:

at least one flap on one of said sections, the other of said sections having a slot disposed to receive said flap when said sections are in longitudinal alignment in sequence.

6. A template as defined in claim 5, wherein said one section has at least two flaps at an angle with respect to each other, and said other section is provided with corresponding slots to receive said flaps.

* * * * *